US009835184B2

(12) United States Patent
Bishop-Moser et al.

(10) Patent No.: US 9,835,184 B2
(45) Date of Patent: Dec. 5, 2017

(54) FIBER-REINFORCED ACTUATOR

(71) Applicant: The Regents of the University of Michigan, Ann Arbor, MI (US)

(72) Inventors: Joshua Bishop-Moser, Ann Arbor, MI (US); Girish Krishnan, Mahomet, IL (US); Sridhar Kota, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 524 days.

(21) Appl. No.: 14/457,086

(22) Filed: Aug. 11, 2014

(65) Prior Publication Data

US 2015/0040753 A1 Feb. 12, 2015

Related U.S. Application Data

(60) Provisional application No. 61/864,526, filed on Aug. 10, 2013.

(51) Int. Cl.
*F01B 19/04* (2006.01)
*F15B 15/10* (2006.01)

(52) U.S. Cl.
CPC ..... *F15B 15/10* (2013.01); *F15B 2215/305* (2013.01)

(58) Field of Classification Search
CPC ..... F15B 15/103; B25D 1/02; B25J 9/142
USPC ..... 92/90, 91, 92; 318/560.12; 294/98.1
See application file for complete search history.

(56) References Cited

U.S. PATENT DOCUMENTS 3,729,028 A * 4/1973 Horvath ..... F16L 11/088 138/130
4,792,173 A * 12/1988 Wilson ..... B25J 9/1075 294/119.3
4,819,547 A * 4/1989 Kukolj ..... F15B 15/103 92/153
5,080,000 A * 1/1992 Bubic ..... B25J 18/06 294/119.3
5,727,391 A * 3/1998 Hayward ..... B25J 9/1085 248/636
6,016,845 A * 1/2000 Quigley ..... D04C 1/06 138/125
8,245,799 B2 * 8/2012 Chiel ..... F03G 7/00 180/7.1
2002/0083828 A1 * 7/2002 Bernier ..... F04B 9/10 92/92

(Continued)

*Primary Examiner* — Thomas E Lazo
*Assistant Examiner* — Dustin T Nguyen
(74) *Attorney, Agent, or Firm* — Reising Ethington P.C.

(57) ABSTRACT

A fiber reinforced actuator includes first and second sets of fibers coupled with and arranged along a control volume to controllably constrain mobility of an actuator body. Fibers of the first set can be arranged with respect to fibers of the second set and with respect to a central axis to impart the actuator with various combinations of torsional and axial force responses. A third fiber may be included to form a helical actuator. A plurality of actuators can be coupled together for coordinated movement, thereby providing additional mobility directions, such as trans-actuator bending. The fiber-reinforced actuators and actuator assemblies are potential low cost, low energy consumption, lightweight, and simple replacements for existing motion devices such as servo-motor driven robots.

51 Claims, 7 Drawing Sheets

(56) References Cited

U.S. PATENT DOCUMENTS

2012/0094041 A1* 4/2012 Parfrey ..... B29C 70/222
428/34.1

* cited by examiner (a) (b) (c) (d)

FIBER-REINFORCED ACTUATOR

STATEMENT OF FEDERALLY-SPONSORED RESEARCH

This invention was made with government support under CMMI1030887 awarded by the National Science Foundation. The Government has certain rights in the invention.

TECHNICAL FIELD

This disclosure is related generally to actuators and, more particularly, to actuatable structures that exhibit a controlled response to work performed on a control volume.

BACKGROUND

Actuators are devices that exhibit a predictable motion, change in rigidity, force and/or moment in response to a particular input. One common type of fluid-driven actuator is a pneumatic cylinder, in which air pressure is typically used to extend or retract a solid rod along a tubular enclosure. Such actuators are characterized by a single degree of freedom (DOF) and components that slide relative to one another. Devices exhibiting multiple degrees of freedom of movement often require multiple single DOF actuators. Devices capable of motion along complex motion paths, such as multi-axis servo-driven robotic, can be very expensive and require complex programmable control systems. Modern robotics also require special considerations regarding safety in manufacturing environments where humans are also present.

SUMMARY

In accordance with one or more embodiments, a fiber-reinforced actuator includes a body and an associated control volume. The body extends for a length along a central axis of the control volume. The actuator also includes a first set of fibers and a second set of fibers. Each set of fibers is coupled with the body and extends about the control volume and/or along the length of the body at an angle relative to the central axis. Fibers of the first set of fibers are at an angle $\alpha$, and fibers of the second set of fibers are at an angle $\beta$, with $\alpha \neq \pm\beta$. The orientation of the fibers of the first and second sets of fibers meets one of the following criteria:

$90° > \alpha > 90°$ and $-90° > \beta > 90°$, or $\alpha = 90°$ and $\beta \neq 0$.

In accordance with one or more additional embodiments, a fiber-reinforced actuator includes a body and an associated control volume. The body extends for a length along a central axis of the control volume. The actuator also includes a first set of fibers and a second set of fibers. Each set of fibers is coupled with the body and extends about the control volume and/or along the length of the body. Fibers of the first set are non-parallel with fibers of the second set, and the sets of fibers are oriented with respect to each other such that, when work is performed on the control volume to actuate the actuator, the actuator exhibits a pre-determined response that includes a moment about the central axis.

In accordance with one or more additional embodiments, a fiber-reinforced actuator includes a body and an associated control volume. The body extends for a length along a central axis of the control volume. The actuator also includes a first set of fibers and a second set of fibers. Each set of fibers is coupled with the body and extends about the control volume and/or along the length of the body at an angle relative to the central axis. Fibers of the first set of fibers are at an angle $\alpha$, and fibers of the second set of fibers are at an angle $\beta$, with $\alpha \neq \beta$. An additional fiber extends along the control volume and/or along the length of the body at an angle $\gamma$ relative to the central axis, with $\gamma \neq 0$.

BRIEF DESCRIPTION OF THE DRAWINGS

Illustrative embodiments will hereinafter be described in conjunction with the appended drawings, wherein:

FIG. 5(*b*) is a side view of the actuator of FIG. 5(*a*) in an actuated state;

DESCRIPTION OF THE ILLUSTRATED EMBODIMENTS

Described below is a fiber-reinforced actuator capable of complex and predictable movement and/or freedom of movement. Sets of fibers are oriented at unconventional angles along a control volume and at least partially constrain movement of an actuator body with which they are coupled. The fiber-reinforced actuator can be configured to provide rotational motion, a combination of rotational and axial motion, a change in rigidity, axial force, torsional force, and/or a combination of axial and torsional forces in response to work performed on the control volume.

One particular example of the fiber-reinforced actuator is a fiber-reinforced elastomeric enclosure (FREE). This particular type of actuator includes fibers wrapped about and along an elastomeric body in a given configuration. The fibers are disposed over or are at least partially embedded in the elastomer such that fluid pressure and/or volume displacement predictably actuates the enclosure. FREEs potentially offer vastly superior performance over other types of actuators, such as robotic or mechanical devices, with lightweight construction, energy efficient operation, providing enhanced functionality, and greater simplicity. It should be understood that the various combinations of fiber configurations disclosed and described herein are not limited to use with elastomeric enclosures or for exclusive use with fluidic control volumes. Rather, the ability to configure fibers with respect to a control volume to controllably constrain an actuator body with a predictable response according to the following teachings is useful with a wide range of materials and shapes.

Figure 1:
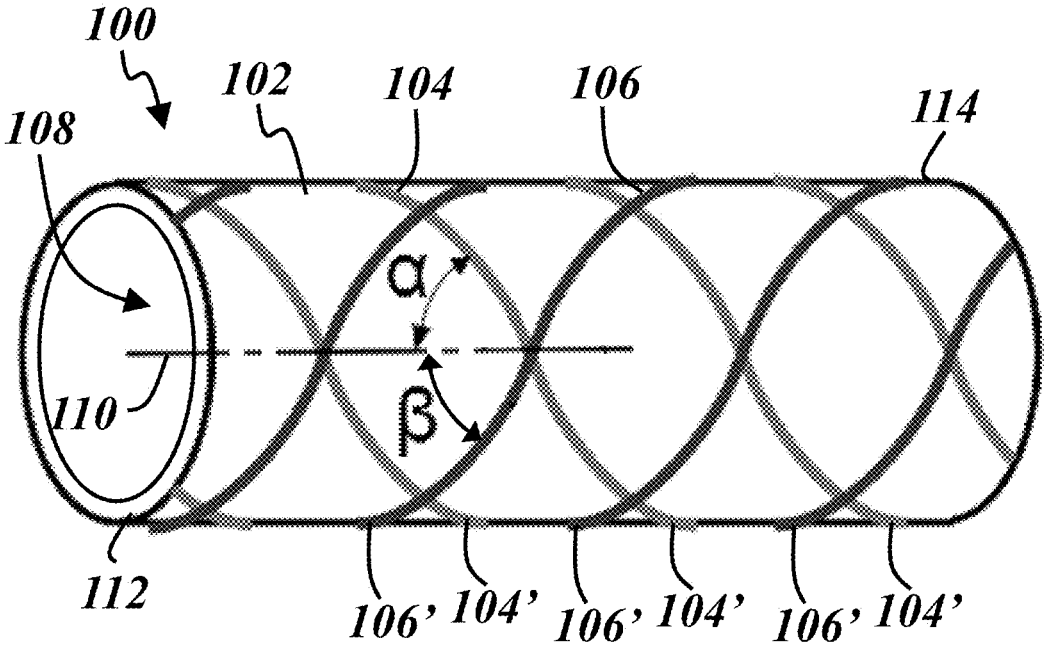
FIG. 1 is a side-view of an embodiment of a fiber-reinforced actuator.

FIG. 1 is a schematic side view of an example of a fiber-reinforced actuator 100, including a body 102, a first set of fibers 104, and a second set of fibers 106. The actuator body 102 has an associated control volume 108 with a central axis 110. In the illustrated example, the body 102 is tubular with a cylindrical control volume 108 and extends for some length along the control volume in the direction of the axis 110. One or both of opposite ends 112, 114 may be a closed end to partially define the control volume 108. In one embodiment, a first end 112 is configured for attachment to a fluid pressure source and the opposite second end 114 is a closed end, such that, when attached to the pressure source, the pressure of the control volume 108 is determined by the pressure of the fluid source.

The fibers of the first set 104 are oriented at an angle $\alpha$ relative to the central axis 110, and the fibers of the second set 106 are oriented at an angle $\beta$ relative to the central axis. For purposes of notation in this disclosure, each fiber angle $\alpha$, $\beta$ is measured with the central axis 110 assigned a value of 0°, and each angle has a value and a sign (i.e., positive or negative). The value of each angle is between 0° and 90°, inclusive, and the sign of each angle is determined by which direction the 0° to 90° angle is measured from the axis. The respective signs of the angles $\alpha$ and $\beta$ are somewhat arbitrary, in that the direction of measurement depends on which side the actuator is viewed from. The significance of the sign of each angle $\alpha$, $\beta$ is whether they are the same or opposite signs. Generally, when the fibers of the first set 104 are slanted in the same direction as the fibers of the second set 106 when viewed from the side as shown, the angles $\alpha$ and $\beta$ have the same sign. Likewise, when the fibers of the first set 104 are slanted in the opposite direction as the fibers of the second set 106, as is the case in the example of FIG. 1, the angles $\alpha$ and $\beta$ have opposite signs. For purposes of this disclosure, fibers slanted like the first set 104 in FIG. 1 are considered to have a positive angle, and fibers slanted like the second set 106 in FIG. 1 are considered to have a negative angle.

Each set of fibers 104, 106 includes a plurality of individual fibers 104', 106'. In the illustrated example, each set 104, 106 includes three individual fibers, with the individual fibers arranged parallel with each other within each set in a helical manner about the circumference of the body 102. The number of individual fibers in any set of fibers may be any number of two or more.

In the particular example of FIG. 1, the angle $\alpha$ of the fibers of the first set 14 is equal in value and opposite from the angle $\beta$ of the fibers of the second set, or $\alpha=-\beta$. Depending on the value of the fiber angles, this type of actuator exhibits extension or contraction in the direction of the central axis 110 when the pressure of the control volume 108 is increased. In other words, the fibers constrain movement of the body in a manner that distributes the forces due to the pressure increase tend to cause the body to lengthen or shorten. While this type of movement, similar to the above-described pneumatic cylinder, is useful, other combinations of angle values and directions are available that result in rotational movement or torsional force, in some cases in combination with axial movement or force. Yet other combinations are useful to increase the stiffness of the actuator 100 while allowing freedom of movement in one or more translational or rotational directions.

Figure 2:
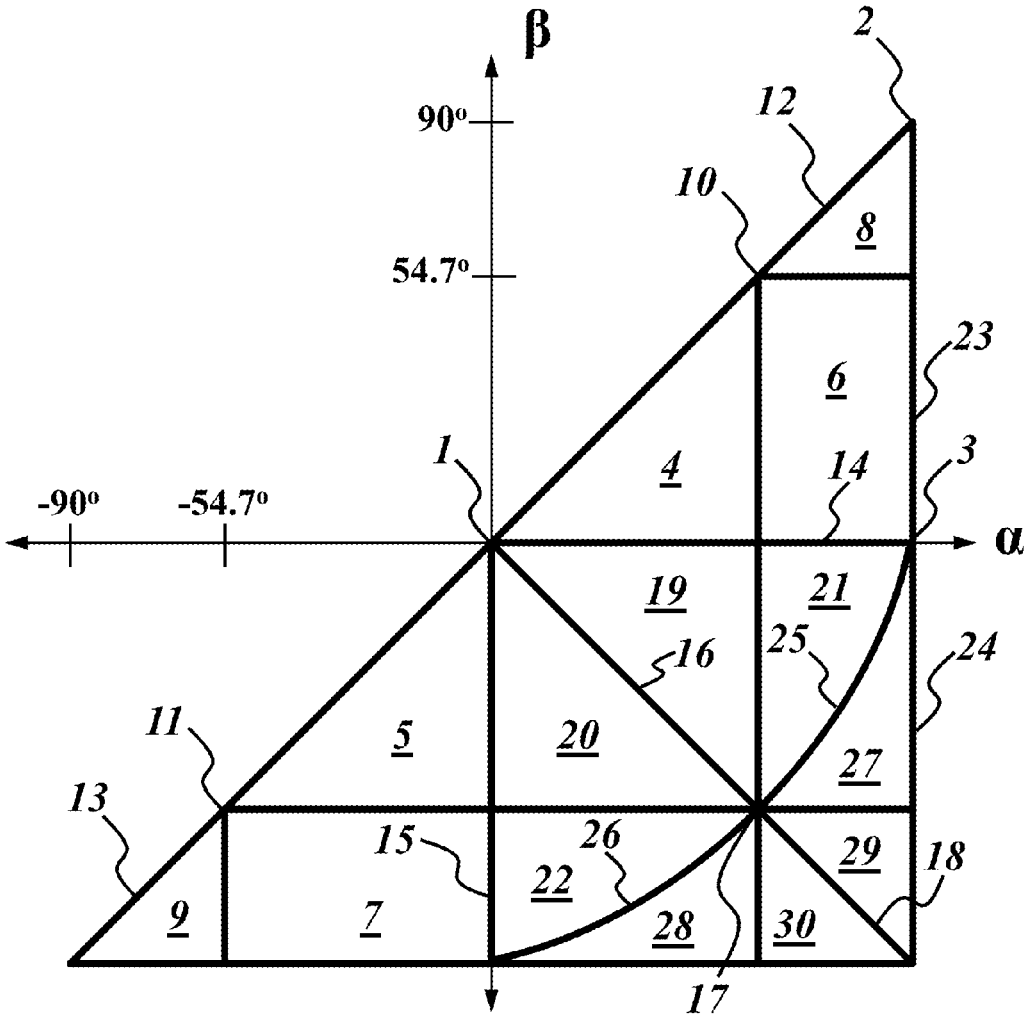
FIG. 2 is a chart illustrating various different regions of the available design space for the fiber-reinforced actuator with a fiber set at an angle $\alpha$ and a fiber set at an angle $\beta$.

FIG. 2 is a chart illustrating various regions 1-30 of a design space for the fiber-reinforced actuator. Each region is represented as a point, a segment, or an area in the chart of FIG. 2, and each adjacent region differs in at least one mobility direction. Types of mobility directions include an actuation direction and a freedom direction. The possible mobility directions are axial extension, axial contraction, counter-clockwise (CCW) rotation, clockwise (CW) rotation, transverse bending, combined CCW rotation and axial extension, combined CW rotation and axial extension, combined CCW rotation and axial contraction, combined CW rotation and axial contraction, combined CW rotation and transverse bending, and combined CCW rotation and transverse bending. Clockwise and counter-clockwise rotational directions are as viewed from the center of the actuator looking toward an end. For example, the actuator described by $\alpha=-\beta$ is represented in FIG. 2 by regions 16-18, including segments 16 and 18 and point 17. An actuator with fibers oriented in accordance with regions 16 and 18 respectively have axial contraction and axial expansion actuation directions when work is performed on the control volume. An actuator with fibers oriented as in region 17 has no actuation direction. None of regions 16-18 has a rotational actuation direction. Each of these regions also has multiple freedom directions, which are discussed in further detail below.

The actuator may be constructed to include a mobility direction with a rotational component. In one embodiment, the fiber-reinforced actuator is constructed such that $\alpha\neq\pm\beta$, and the orientation of the fibers of the first and second sets of fibers meets one of the following criteria:

$-90°>\alpha>90°$ and $-90°>\beta>90°$; or $\alpha=90°$ and $\beta\neq0$, encompassing at least regions 4-9, 14-15, and 19-30 of FIG. 2. In another embodiment, fibers of the first set are non-parallel with fibers of the second set, and the sets of fibers are oriented such that, when work is performed on the control volume, the actuator exhibits a pre-determined motion response that includes a moment about the central axis. The moment may be a torsional force or may result in rotation about the central axis.

The chart of FIG. 2 includes certain threshold values and regions along with certain symmetrical characteristics. One set of threshold values is where either set of fibers is oriented at $\pm\tan^{-1}[\sqrt{2}]$, approximated in FIG. 2 as ±54.7°, representing a boundary between several adjacent regions. The curved segments representing regions 25 and 26 are threshold regions, representing boundaries between other regions. Regions 17, 25, and 26 lie along a curved line described by the following relationship:

$$\alpha = \cot^{-1}\left[\frac{-1}{2\cot(\beta)}\right].$$

These thresholds are useful to describe the boundaries of each region of FIG. 2. The chart of FIG. 2 also exhibits symmetry about the line $\alpha=-\beta$, with corresponding regions on opposite sides of the line having the same translational direction and opposite rotational directions. For example, region 21 has an actuation direction of coordinated CCW/axial contracting screw motion, while region 22 has an actuation direction of coordinated CW/axial contracting screw motion.

Figure 3:
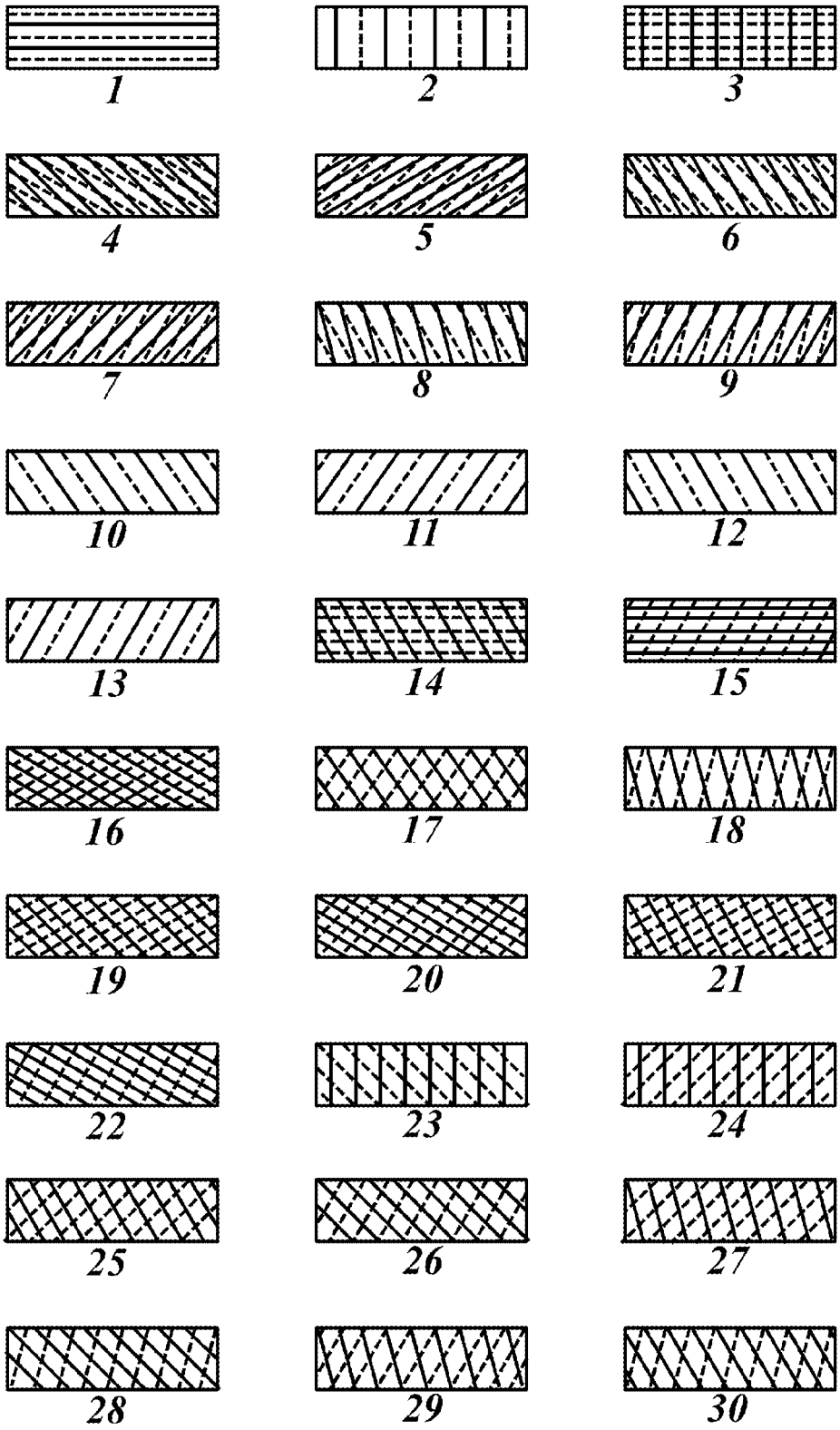
FIG. 3 schematically illustrates regions 1-30 of the chart of FIG. 2 as side views of embodiments of the fiber-reinforced actuator.

FIG. 3 schematically illustrates examples of actuators with fibers configured according to each of regions 1-30. In FIG. 3, the rectangles represent the body of the actuator, the solid lines represent the first set of fibers at angle α, and the broken lines represent the second set of fibers at angle β. The spacing between fibers is schematic, in that straight lines are used in FIG. 3 for simplicity, while fibers extending along cylindrical surfaces would have some apparent curvature and non-uniform spacing when actually viewed from the side.

Fiber configurations that lie along an axis of FIG. 2 (i.e., regions 14 and 15) have purely rotational actuation directions. Fiber configurations that lie along the line α=−β (i.e., regions 16 and 18) have purely translational actuation directions, except region 17. Fiber configurations in accordance with regions 17, 25, and 26 do not have an actuation direction in the sense of providing a force or movement in any direction. These configurations constitute actuators with a locked volume—i.e., the control volume cannot increase when work is performed thereon. Fiber configurations that lie along the line α=β (i.e., regions 1, 2, and 10-13) have the first and second sets of fibers parallel with each other along the actuator body and thus behave as if only one set of fibers is used, effectively negating any affect of the relationship between the angles of different sets of fibers.

TABLE I below includes mobility mapping for fiber-reinforced actuators having fiber configurations according to regions 1-30 of FIG. 2. The left column lists the regions as labeled in FIG. 2. Eleven possible mobility directions are given for each region. The letter "A" appears in the table where the mobility direction is an actuation direction, the letter "F" appears in the table where the mobility direction is a freedom direction, and the letters "AF" appear in the table where the mobility direction is a direction the has both actuation and freedom components. An actuation direction is a direction in which the actuator moves, or a direction in which the actuator applies a force if resistance is encountered. A freedom direction is a direction in which the control volume is constant. Locked volumes may be moved in a freedom direction even though they have no actuation direction. A direction with both actuation and freedom components may be considered a secondary actuation direction such that, if the actuator encounters resistance in the primary actuation direction, movement and/or force is exhibited in the AF direction. Anything not listed as an A, F, or AF is a constraint—i.e., a direction that would reduce the control volume or extend the fibers.

TABLE I

| REGION | MOBILITY DIRECTION (FIG. 4) | | | | | | | | | | |
|---|---|---|---|---|---|---|---|---|---|---|---|
| (FIG. 2) | A | B | C | D | E | F | G | H | I | J | K |
| 1 | — | F | F | F | — | — | — | — | — | — | — |
| 2 | A | — | F | F | F | AF | AF | — | — | F | F |
| 3 | — | — | F | F | — | — | — | — | — | — | — |
| 4 | — | A | A | — | F | F | — | A | F | — | AF |
| 5 | — | A | — | A | F | — | F | F | A | AF | — |
| 6 | — | — | AF | — | F | A | — | F | — | — | AF |
| 7 | — | — | — | AF | F | — | A | — | F | AF | — |
| 8 | AF | — | AF | — | F | A | — | F | — | — | AF |
| 9 | AF | — | — | AF | F | — | A | — | F | AF | — |
| 10 | — | — | A | — | F | F | — | F | — | — | AF |
| 11 | — | — | — | A | F | | F | — | F | AF | — |
| 12 | A | — | A | — | F | A | F | F | — | — | AF |
| 13 | A | — | — | A | F | F | A | — | F | AF | — |
| 14 | — | — | A | — | — | — | — | F | — | — | F |
| 15 | — | — | — | A | — | — | — | — | F | — | — |
| 16 | — | A | — | — | F | — | — | F | F | — | — |

TABLE I-continued

| REGION | MOBILITY DIRECTION (FIG. 4) | | | | | | | | | | |
|---|---|---|---|---|---|---|---|---|---|---|---|
| (FIG. 2) | A | B | C | D | E | F | G | H | I | J | K |
| 17 | F | F | — | — | F | — | — | — | — | — | — |
| 18 | A | — | — | — | F | F | F | — | — | — | — |
| 19 | — | AF | — | — | F | — | — | A | F | — | — |
| 20 | — | AF | — | — | F | — | — | F | A | — | — |
| 21 | — | — | — | — | F | — | — | A | — | — | — |
| 22 | — | — | — | — | F | — | — | — | A | — | — |
| 23 | — | — | F | — | F | A | — | — | — | — | F |
| 24 | — | — | — | F | F | — | A | — | — | F | — |
| 25 | — | — | — | — | F | — | F | F | — | — | — |
| 26 | — | — | — | — | F | F | — | — | F | — | — |
| 27 | — | — | — | — | F | — | A | — | — | — | — |
| 28 | — | — | — | — | F | A | — | — | — | — | — |
| 29 | AF | — | — | — | F | F | A | — | — | — | — |
| 30 | AF | — | — | — | F | A | F | — | — | — | — |

Figure 4:
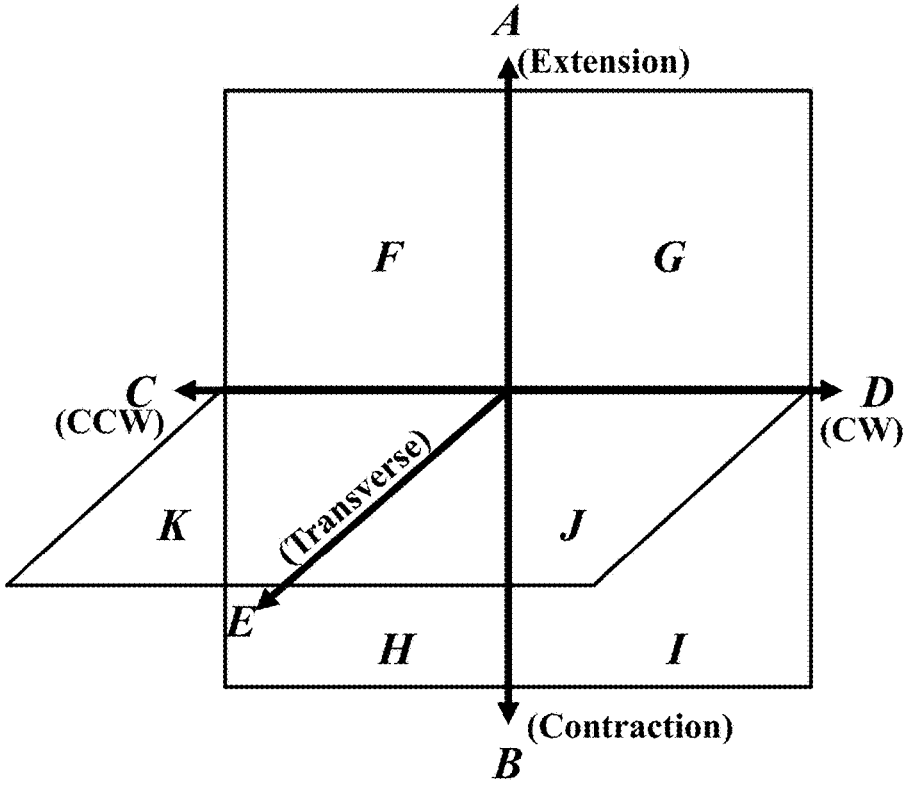
FIG. 4 illustrates the available mobility directions for the fiber-reinforced actuator.

The eleven possible mobility directions are mapped in FIG. 4, where direction A is axial extension, direction B is axial contraction, direction C is counter-clockwise (CCW) rotation, direction D is clockwise (CW) rotation, direction E is transverse bending in all directions, direction F is combined CCW rotation and axial extension, direction G is combined CW rotation and axial extension, direction H is combined CCW rotation and axial contraction, direction I is combined CW rotation and axial contraction, direction J is combined CW rotation and transverse bending, and direction K is combined CCW rotation and transverse bending.

By way of example, a fiber-reinforced actuator with the fibers configured as in region 19 of FIG. 2 has one set of fibers oriented at a positive angle of less than 54.7° and the other set at a negative angle greater than −54.7°, with the magnitude of the positive angle greater than the magnitude of the negative angle. With reference to TABLE I, this configuration has an actuation direction H, freedom directions E and I, and both actuation and freedom components in direction B. Matching these mobility directions with FIG. 4, the actuation directions is coordinated counter-clockwise rotation and axial contraction. Thus, when the control volume of this actuator increases, the actuator will exhibit screw-like motion, twisting and shortening in length. If resistance is encountered against this motion, pure axial contraction may occur. This actuator also has freedom of movement in the combined CW/contraction direction and in the transverse direction.

Fiber-reinforced elastomeric enclosures (FREEs) have been constructed, tested, and characterized to confirm predictable actuation responses described above. Natural latex rubber tubing was used as the actuator body. A rigid or semi-rigid plastic rod or tube may be used as a mandrel to support the flexible wall from the inside of the rubber tubing during construction. Sets of strings or other fibers can then be fixed at one end of the tubing and wrapped in a helical fashion along the outside of the tubing, then fixed at the opposite end of the tubing. One end can be sealed off with a plastic cap. A latex coating (e.g., rubber cement) can then be applied over the string fibers to embed the string in elastomeric material and to fix the location and desired angles of the string. The support rod can be removed from the completed actuator. This is only one simple example of the fiber-reinforced actuator. The number of combinations of materials, shapes, and sizes are virtually limitless.

For example, the body of the actuator in the example of FIG. 1 is a tube with an annular cross-section, where the inner diameter partly defines the control volume. The actuator assumes the general shape of the body when in an unactuated or free state. For a pressure actuated device, the free state is determined either at atmospheric pressure or when the pressure of the control volume is equal to the pressure outside the control volume. Other examples of suitable body shapes include tapered cylinders (i.e., conical or frustoconical shapes), spherical or ellipsoidal shapes, an elongated shape with different diameter cylindrical portions, or an elongated shape with a variable diameter. These examples are all symmetric about a central axis. Non-cylindrical tubes, such as tubes with square or hexagonal cross-sections, may also be employed as the actuator body. In some embodiments, the body is a pre-bent tube or cylinder. A fiber-reinforced actuator with a pre-bent body may be configured to straighten when actuated, for example.

The angle of each fiber or each set of fibers need not be constant. The angle of any fiber of a set or of any set of fibers or of a single fiber can change along the length of the actuator body, either as a step change or as a gradual change.

While the above-described FREEs have bodies formed from an elastomeric material, such as natural rubber, the actuator body may be formed from nearly any material. In applications where relatively large movement is desired at low input energy, elastomers or other flexible materials or material combinations may be preferred. Elastomeric materials may also provide a high coefficient of friction in applications where it is intended that force applied to an object by the actuator helps grip the object. Certain fabric or textile materials may also be suitable when low resistance to movement by the body is desired. In some cases, rigid or semi-rigid polymers such as plastics or epoxy materials may be employed as the body material. Metal materials can also be used in the actuator body, such as in applications where high stiffness is required in the free state, where RF shielding or conductivity is required, etc.

In embodiments where the body has a hollow interior, such as with the above-referenced tubular body, the wall thickness may range from a very thin film on the micron scale, to any fraction of the overall width or diameter of the body. Functional FREEs have been constructed with latex tubing having a 1/32-inch (about 0.030" or 0.8 mm) wall thickness and a 3/8-inch (0.375" or 9.5 mm) inner diameter. It is also possible to employ a solid body, such as a body material with a high thermal expansion coefficient with which the actuation mechanism is volume change due to temperature change.

The fibers may be any thickness (carbon nanotube or single material chain up to very thick fibers) and may be formed of any of the following materials or any combination of materials. Also, the individual fibers within each of the first and second sets may be formed of the same or different materials or dimensions and, as well, the fibers of one set may be the same or different than the fibers of the other set. The fibers can be natural fibers (e.g., cotton, wool, or bamboo or other bast fibers) or synthetic fibers (e.g., nylon, polyester, Kevlar). Other fiber types include carbon fibers, glass fibers, metal fibers or cables, and hybrid fibers containing a mixture of any of these types of fibers. The fibers may be selected to have high tensile stiffness with negligible stiffness in other directions (i.e., transverse and compressive), such as is the case with thread, string, or rope. The fibers may also take the form of thin beams of metal or plastic that are capable of supporting a compressive axial load. High compressive stiffness fibers or beams may provide actuator deformations that would otherwise buckle fibers. For instance, an actuator configured with cotton string as the fibers with a combination of angular orientations that provide axial contraction when actuated may be made to exhibit transverse bending if one or more of the cotton fibers was replaced with a high-compressive stiffness fiber, such as metal or thick cross-section polymeric fibers. Another type of fiber material is a shape memory alloy, which may be used to add yet another degree of control or functionality to the actuator.

The composition of the control volume can be that of any fluid, such as air, a gas or gas mixture other than air, water, hydraulic fluid, biological fluid (e.g., blood or plasma), magnetic fluid (e.g., rheomagnetic material), or that of any other type of material capable of volume change, such as chemically active materials or combustible materials, which rely on chemical reactions to perform work on the control volume. Electroactive polymers or metals in the control volume may be actuated by application of a voltage. The control volume may also include polymeric materials, such as parylene or foam materials. Fluid absorbing materials may also be employed in the control volume to actuate the device by volume increase due to fluid absorption. The control volume may be composed of or include particles to be used for jamming.

Generally, an increase in volume of the control volume actuates the fiber-reinforced actuator. This volume increase can be accomplished by increased fluid pressure or displacement, increased control volume temperature, decreased pressure outside the control volume, a chemical reaction (e.g., catalyst or combustion reactions), flow restriction into or out of the control volume, or adding additional material to the control volume. As noted above, some actuator configurations have a locked volume and do not accommodate a volume increase. These actuators may still be considered actuated when work is performed on the control volume. For instance, the actuator may exhibit increased stiffness when pressurized or otherwise actuated.

The size of the fiber-reinforced actuator is virtually unlimited as well, ranging from the nanoscale to vary large, such as building or infrastructure size. These actuators may be used alone, coupled together with one or more other fiber-reinforced actuators and/or conventional actuators for more complex motion or high-force generation. The actuators may be employed as springs with the possibility of variable stiffness at two or more different actuation levels or on a continuously variable actuation scale. They may be employed as integrated actuators (including active surfaces), structural members, fluid pumps, shape changing or shape generation devices, end point positioning devices, or volume expanding devices.

Figure 5:
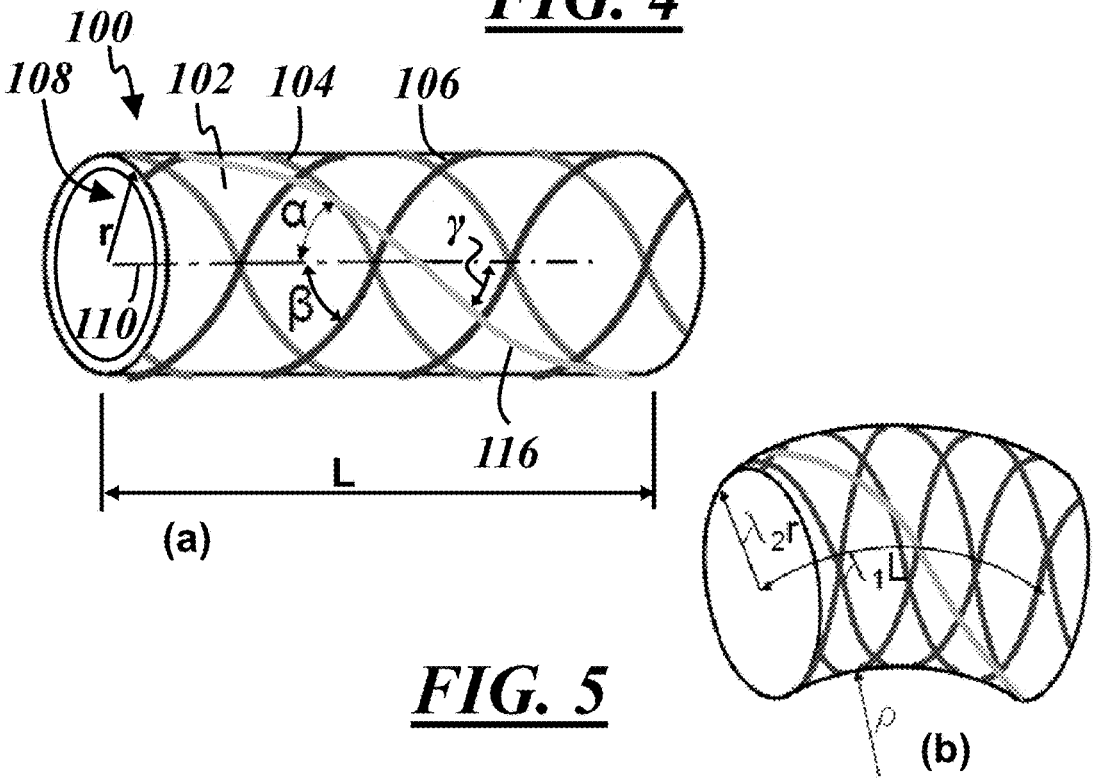
FIG. 5(*a*) is a side view of an embodiment of a helical fiber-reinforced actuator in a free state.

Another embodiment of the fiber-reinforced actuator 100 is illustrated in FIG. 5. This example includes an additional single fiber 116 extending along the control volume at a third angle $\gamma$ in addition to the first and second fiber sets 104, 106 described above. This fiber-reinforce actuator may be referred to as a helical actuator, or a helical FREE where the body 102 is elastomeric. FIG. 5(*a*) depicts the helical actuator in the free state, and FIG. 5(*b*) depicts the helical actuator in an actuated state, illustrating stretching and bending of the portion of the actuator shown in the figure. In this example, $\gamma \neq 0$ and $\alpha \neq \beta$. In one particular embodiment, $\alpha = -\beta$, thus combining the two fiber set configuration of regions 16-18 of FIG. 2 with the additional single fiber 116.

Figure 6:
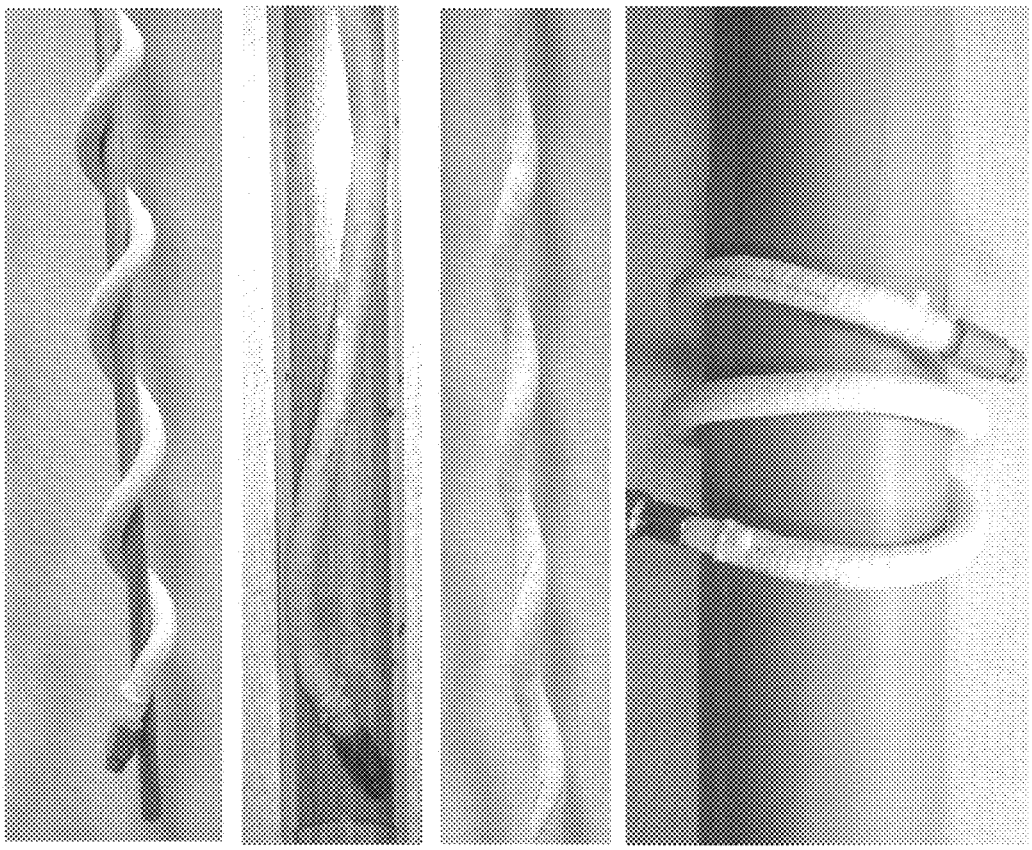
FIGS. 6(*a*)-6(*d*) are photographic images of fabricated embodiments of the helical fiber-reinforced actuator.

Helical FREEs with latex actuator bodies have been successfully constructed and operated, some examples of which are shown in photographic images in FIGS. 6(*a*)-6(*d*). The particular actuator of FIG. 6(*a*) has a fiber configuration wherein $\alpha = 88°$, $\beta = -60°$, and $\gamma = 10°$. The actuator is shown grasping a metal rod and has the ability to support hundreds of times its own weight. The illustrated helical actuator was actuated with a volume increase of 30%. In the actuated state, the helical shape of the actuator had a helix angle of about 56° and a helix radius of about 11.4 mm. FIG. 6(*b*) shows the actuator grasping the inner surface of a clear tube. FIG. 6(*c*) is another helical actuator configuration with $\alpha=-70°$, $\beta=-30°$, and $\gamma=1°$. The resulting helix angle is about 59° and the resulting helix radius is about 9.3 mm with an actuated volume increase of 35%. FIG. 6(*d*) is a photographic image of another helical configuration, with $\alpha=65°$, $\beta=-80°$, and $\gamma=5°$. At an actuated volume increase of 15%, the helix angle is about 9° and the helix radius is about 51°. Each actuator of FIGS. 6(*a*)-6(*d*) had a body radius of 5.5 mm.

Figure 7:
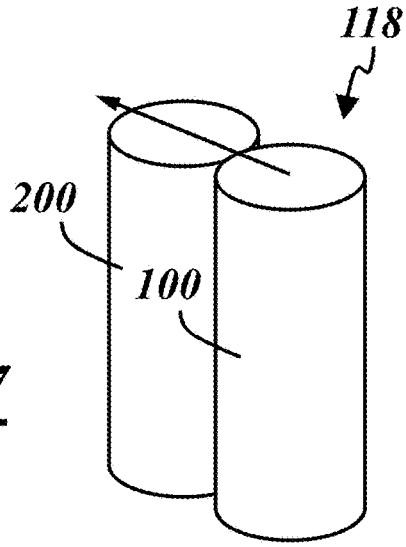
FIG. 7 illustrates a pair of parallel actuators with a trans-actuator bending mobility direction.

A fiber-reinforced actuator assembly can be constructed from one or more of any of the above-described fiber-reinforced actuators. In one embodiment an actuator assembly includes a fiber-reinforced actuator with a rotational actuation direction component, and another fiber-reinforced actuator with only a translational actuation direction. In other embodiments, the assembly includes a plurality of actuators with rotational actuation direction components. One example of an actuator assembly 118 is schematically shown in FIG. 7 and includes a pair of fiber-reinforced actuators 100, 200. New mobility directions are introduced with a coupled pair of parallel actuators. One such mobility direction is illustrated in FIG. 7 as trans-actuator bending, where the pair of actuators bends one toward the other. Described below are some of the necessary conditions for certain parallel mobility directions.

For a parallel pair of actuators, a set of four rules determines all motion directions that are not screw motions. First, transverse bending is a parallel mobility if and only if both actuators have mobility in transverse bending. Second, axial translation is a parallel mobility if and only if both actuators have mobility in axial translation in the parallel mobility direction. Third, rotation is a parallel mobility if and only if both actuators have mobility in rotation in the parallel mobility direction. Fourth, trans-actuator bending is a parallel mobility in the direction towards the axially contracting actuator 200 or away from the axially extending actuator 100 if and only if both actuators have mobility in transverse bending and at least one of actuators has mobility in axial translation.

For screw motions that combine rotation with axial translation, three conditions need to be met. First, each actuator must either axially translate in the parallel mobility direction or have a coupled translation and rotation identical to the parallel mobility direction. Second, each actuator must either rotate in the parallel mobility direction or have a coupled translation and rotation identical to the parallel mobility direction. Third, at least one of the actuators must have a coupled translation and rotation identical to the parallel mobility direction.

For screw motions that combine rotation with transverse bending, three conditions need to be met. First, each actuator must either transversely bend or have a coupled bend and rotation, with the rotation in the parallel mobility direction. Second, each actuator must either rotate or have a coupled bend and rotation, and the rotation components of the motion must both be in the parallel mobility direction. Third, at least one of the actuators must have a coupled bend and rotation with the rotation in the parallel mobility direction.

For screw motions that combine rotation with trans-actuator transverse bending, four conditions need to be met. First, each actuator must either transversely bend or have a coupled bend and rotation, with the rotation in the parallel mobility direction. Second, at least one of actuators must have mobility in either axial translation or a coupled axial translation and rotation, with the rotation in the parallel mobility direction; the parallel mobility must be in the direction towards the axially contracting element or away from the axially extending element. Third, each actuator must either rotate, have a coupled transverse bend and rotation, or coupled axial translation and rotation, where the rotation is in the parallel mobility direction, and the parallel mobility must be in the direction towards the axially contracting element or away from the axially extending element. Fourth, at least one of the actuators must have either a coupled translation and rotation or a coupled transverse bending and rotation, where the rotation is in the same direction as that of the parallel mobility direction, and the parallel mobility must be in the direction towards the axially contracting element or away from the axially extending element.

Figure 8:
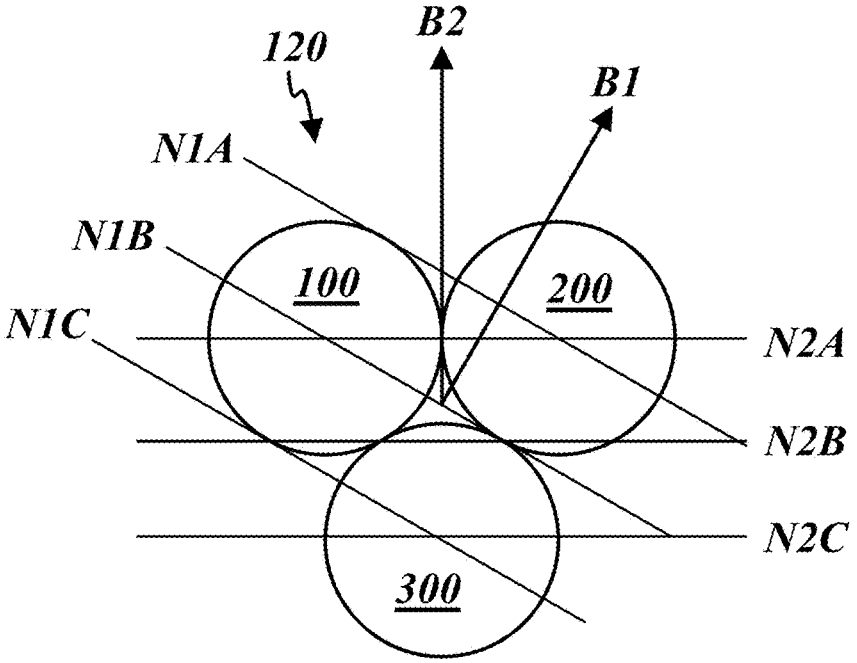
FIG. 8 is a top view of a triangular triplet of actuators, showing bending directions and neutral axes.

In another embodiment, an actuator assembly 120 includes three fiber-reinforced actuators 100, 200, 300. FIG. 8 illustrates a top view diagram of some of the notation necessary for understanding how to control mobility directions of a triangular triplet of parallel actuators. The coupling of triangular triplets of actuators is similar to that of pairs of actuators, but with additional complexity in the mobility direction that involves trans-actuator transverse bending. Transverse bending that is not trans-actuator bending is not possible, as there is no direction that is only one actuator in width in the triangular configuration. All transverse bending is thus trans-actuator transverse bending and may be simply referred to as bending. There are 44 coordinate-dependent mobility directions for actuator triplets. Four of the motions follow a simple set of two rules. First, axial translation is a parallel mobility if and only if all actuators have mobility in axial translation in the parallel mobility direction. Second, rotation is a parallel mobility if and only if all actuators have mobility in rotation in the parallel mobility direction.

For mobility directions that are screw motions, additional considerations of screw coupling need to be considered. For parallel screw mobilities that combine rotation with axial translation, three conditions need to be met. First, each actuator must either axially translate in the parallel mobility direction or have a coupled translation and rotation identical to the parallel mobility direction. Second, each actuator must either rotate in the parallel mobility direction or have a coupled translation and rotation identical to the parallel mobility direction. Third, at least one of the actuators must have a coupled translation and rotation identical to the parallel mobility direction.

For bending motions, three different planes may serve as the neutral axis. FIG. 8 illustrates the two fundamental bending directions B1 and B2 for triangular triplets, as well as their respective neutral axis planes: N1A, N1B, and N1C for bending direction B1, and N2A, N2B, and N2C for bending direction B2. For a parallel mobility in bending, the following rules must be met. First, all actuators must have mobility in transverse bending. Second, for bending direction B1, one or more of the following must be true: (a) actuator 200 is axially contracting and actuator 300 is axially extending; (b) actuator 100 and actuator 300 are axially extending; (c) actuator 100 and actuator 200 are axially contracting. Third, for bending direction B2, one or both of the following must be true: (a) actuator 100 and actuator 200 are axially contracting; (b) actuator 300 is axially extending.

There are additional mobility sets in the direction opposite bending directions B1 and B2 by reversing axial extension and axial contractions in each of their respective set of rules.

For each rotation of 120 degrees of the coordinates defining the bending direction and associated actuator numbering, the same conditions will hold true. Screw motions that coordinate bending and rotation require the following conditions. First, the actuators must have axial translations and transverse bending according to the rules used to determine parallel mobility bending in the correct direction. These axial translations and transverse bending may be coupled with rotations, as long as the rotation component of the motion is in the same direction as that of the parallel mobility direction. Second, each actuator must either rotate, have a coupled transverse bend and rotation, or a coupled axial translation and rotation, where the rotation components of the motion are all in the same direction as that of the parallel mobility direction, and the parallel mobility must follow the rules used to determine bending in the correct direction. Third, at least one of the actuators must have either a coupled translation and rotation or a coupled transverse bending and rotation, where the rotation components of the motion are in the same direction as that of the parallel mobility direction, and the parallel mobility must follow the rules used to determine bending in the correct direction.

As is apparent from this above-described multitudes of possible combinations of actuator movements, the fiber-reinforced actuator assemblies of FIGS. 7 and 8 have potential for complex directions and ranges of movement in a low cost, lightweight, low energy consumption configuration. The actuator assemblies can be made with the above-described FREEs and represent the potential for soft-robotics, allowing and machines to safely work side-by-side in a manufacturing environment.

Figure 9:
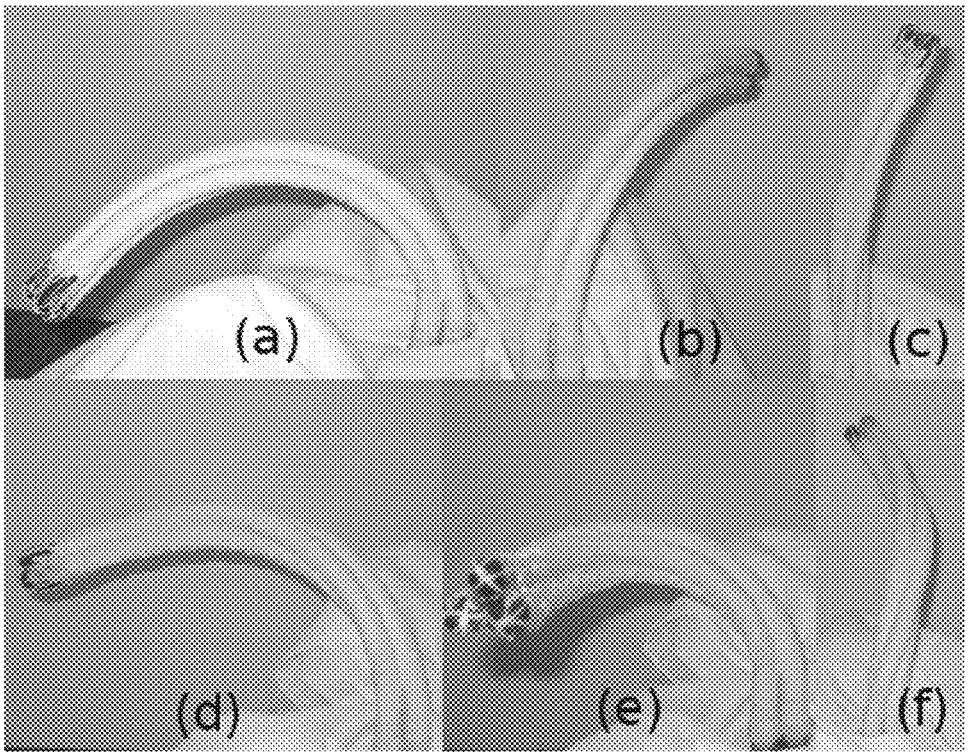
FIG. 9 includes photographic images of an actuator assembly in various states of actuation and exhibiting transverse bending motion, rotational motion, and combinations thereof.

FIG. 9 includes multiple photographic images of an actuator assembly constructed from a triangular triplet of fiber-reinforced actuators. The actuators are individually actuatable, and six different permutations of combinations of actuation pressures are illustrated. FIGS. 9(*a*) and 9(*b*) illustrate transverse bending in different directions, FIGS. 9(*c*) and 9(*f*) illustrate rotational motion, and FIGS. 9(*d*) and 9(*e*) illustrate combined rotational and bending.

Figure 10:
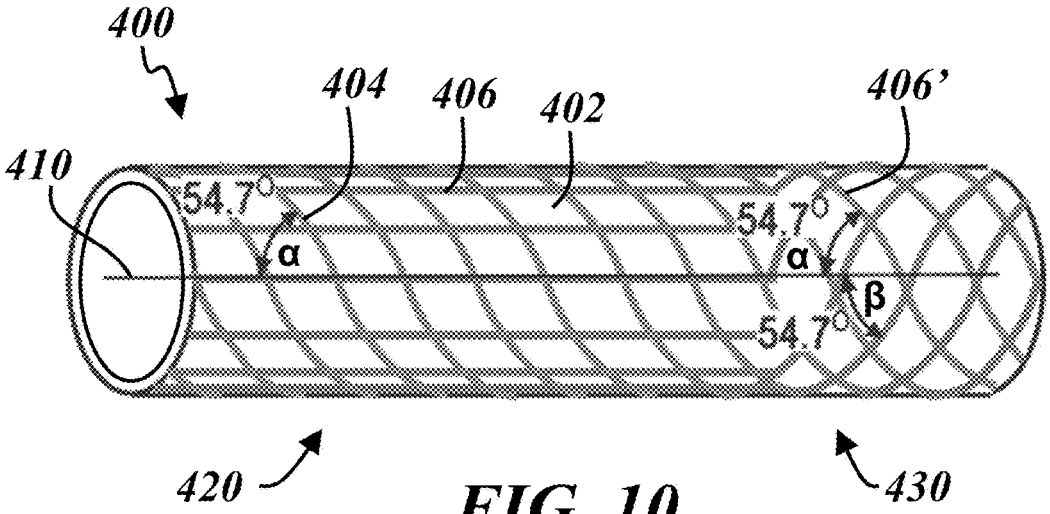
FIG. 10 is a side view of an embodiment of a fiber-reinforced actuator with different fiber configurations along different portions of the actuator body.
Figure 11:
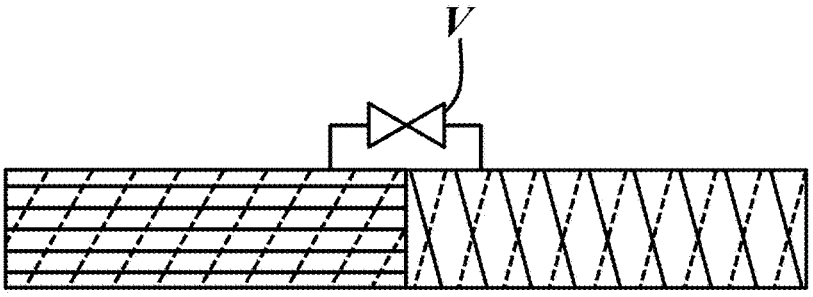
FIG. 11 is a schematic view of an example of an actuator assembly including two actuators from FIG. 3 coupled together in series with their respective control volumes selectively interconnected by a valve (V).

FIG. 10 illustrates another embodiment of a fiber-reinforced actuator 400, wherein the fiber configuration is different along first and second portions 420, 430. In this particular example, the first set of fibers 404 are oriented at the same angle $\alpha$ along both of the first and second portions 420, 430 of the body 402, while the second set or sets of fibers are oriented at two different angles $\beta$ at the first and second portions of the body. In FIG. 10, the second set of fibers is labeled as two different second sets, with second set 406 along the first portion 420 of the body and second set 406' along the second portion 430. It is possible, however, that the second sets 406 and 406' are continuous sets for the length of the body 402. At the first portion 420, the first and second sets 404 and 406 are oriented at respective angles of $\alpha$=54.7° and $\beta$=0°. This corresponds to region 14 of FIGS. 2 and 3. According to TABLE I and FIG. 4, region 14 has only an actuation direction of CCW rotation with no translational component. At the second portion 430, the first and second sets 404 and 406' are oriented at respective angles of $\alpha$=54.7° and $\beta$=−54.7°. This corresponds to region 17 of FIGS. 2 and 3. According to TABLE I and FIG. 4, region 17 has no actuation direction, only freedom directions in translation and transverse bending.

The illustrated actuator 400 is useful as an orthosis device for a person's arm. The first portion 420 can be configured to fit about the user's wrist, and the second portion 430 can be configured to fit along the elbow. In this application, actuation of the orthosis device rotates the wrist and/or forearm of the user. In such an application, it is important that the wrist portion exhibits only rotation, without translation, and is equally important the elbow portion does not actuate with the wrist portion. It is also important that the elbow portion allows for bending. The orientation of the fiber sets can thus be specifically selected for a particular application based on the desired force, moment, degree of freedom, or lack thereof. And different mobility directions can be specified for different portions of the actuator by orienting the fibers in the proper manner.

This is only one of multitudes of potential applications of the fiber-reinforced actuators described and enabled herein. Other types of potential orthotics applications include leg, shoulder, and back orthotics, where the actuators can function as mobility aids, braces with variable stiffness, or powered exoskeletons. Smaller scale orthotics are also possible, such as with fingers and hands. Other potential medical applications include endoscopes, stents, and hospital beds.

Potential aerospace applications include adjustable and/or compliant wings or air foils and complex manipulators. Other potential applications include deployable structures, sensing (e.g., fluid pressure to displacement transducer), grasping (e.g. FREEs as fingers), agricultural robots with soft touch handling of produce, micro-manipulation/assembly, micro flagellum-like motion generation, and active antennas (e.g., changeable shape for frequency tuning).

In these and other applications, actuators can be arranged in parallel concentrically (e.g., one actuator inside another) and/or non-concentrically, arranged in series (e.g., end-to-end), incorporated into meta-material, arranged as sheets of actuators, or arranged with interconnected control volumes, or independent control volumes, or control volumes that selectively interconnect (e.g., via valves). Additional objects or materials may be placed alongside an actuator, such as a thickening element along one side to induce actuator bending motion.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," and "such as," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A fiber-reinforced actuator, comprising:

a body having a control volume, the body extending for a length along a central axis of the control volume;

a first set of fibers coupled with the body, the fibers of the first set extending along the body at an angle $\alpha$ relative to the central axis; and a second set of fibers coupled with the body, the fibers of the second set extending along the body at an angle $\beta$ relative to the central axis;

wherein the fibers of said first and second sets of fibers are exclusive of the control volume and are configured to constrain movement of the body in response to work performed on the control volume to cause the actuator to predictably change in shape or effective rigidity when said work is performed on the control volume, wherein the actuator exhibits a response that includes a moment about the central axis when said work is performed on the control volume, and wherein $\alpha \neq \pm\beta$, and the orientation of the fibers of the first and second sets of fibers meets one of the following criteria:

$-90° > \alpha > 90°$ and $-90° > \beta > 90°$; or $\alpha = 90°$ and $\beta \neq 0$.

2. The fiber-reinforced actuator as defined in claim 1, wherein $\alpha \neq 0$ and $\beta \neq 0$.

3. The fiber-reinforced actuator as defined in claim 1, wherein $\alpha \neq 90°$ and $\beta \neq 90°$.

4. The fiber-reinforced actuator as defined in claim 1, wherein $\alpha \neq \pm\beta$, and the orientation of the fibers of the first and second sets of fibers meets the following additional criteria:

$$\alpha \neq \cot^{-1}\left[\frac{-1}{2\cot(\beta)}\right].$$

5. The fiber-reinforced actuator as defined in claim 1, wherein $\alpha \neq \pm\beta$, and the orientation of the fibers of the first and second sets of fibers meets the following additional criteria only when $-90° < \beta < 0$:

$$-90° < \alpha < \cot^{-1}\left[\frac{-1}{2\cot(\beta)}\right].$$

6. The fiber-reinforced actuator as defined in claim 1, wherein $\alpha \neq \pm\beta$, and the orientation of the fibers of the first and second sets of fibers meets the following additional criteria only when $-90° < \beta < 0$:

$$\cot^{-1}\left[\frac{-1}{2\cot(\beta)}\right] < \alpha < 90°.$$

7. The fiber-reinforced actuator as defined in claim 1, wherein the body comprises an elastomeric tube.

8. The fiber-reinforced actuator as defined in claim 1, wherein the central axis is non-linear when the actuator is in a free state.

9. The fiber-reinforced actuator as defined in claim 1, wherein the fibers of the first and second sets of fibers are at least partially embedded in the body.

10. The fiber-reinforced actuator as defined in claim 1, wherein the control volume is a volume of fluid.

11. The fiber-reinforced actuator as defined in claim 10, wherein the fluid comprises a gas.

12. A fiber-reinforced actuator assembly comprising a fiber-reinforced actuator as defined in claim 1 coupled together with at least one other fiber-reinforced actuator for coordinated movement.

13. The fiber-reinforced actuator assembly as defined in claim 12, wherein respective control volumes of each fiber-reinforced actuator of the assembly are selectively interconnected with each other in series.

14. The fiber-reinforced actuator assembly as defined in claim 12, wherein the fiber-reinforced actuators are coupled together in parallel.

15. A fiber-reinforced actuator assembly comprising two or more fiber-reinforced actuators as defined in claim 1 coupled together for coordinated movement.

16. The fiber-reinforced actuator as defined in claim 1, wherein at least one fiber comprises a shape memory alloy.

17. The fiber-reinforced actuator as defined in claim 1, further comprising an additional fiber extending along the control volume at any angle other than $\alpha$ or $\beta$.

18. The fiber-reinforced actuator as defined in claim 1, wherein at least one of the angles $\alpha$ or $\beta$ changes along the length of the body.

19. A fiber-reinforced actuator, comprising:

a body having a control volume, the body extending for a length along a central axis of the control volume;

a first set of fibers coupled with the body, the fibers of the first set extending along the body at an angle $\alpha$ relative to the central axis; and a second set of fibers coupled with the body, the fibers of the second set extending along the body at an angle $\beta$ relative to the central axis;

wherein fibers of the first set are non-parallel with fibers of the second set, the sets of fibers being oriented with respect to each other such that, when work is performed on the control volume to actuate the actuator, the actuator exhibits a pre-determined response that includes a moment about the central axis, wherein the fibers of the first and second sets of fibers are exclusive of the control volume.

20. The fiber-reinforced actuator as defined in claim 19, wherein the sets of fibers are oriented with respect to each other such that the pre-determined response further includes an axial force.

21. The fiber-reinforced actuator as defined in claim 19, wherein the sets of fibers are oriented with respect to each other such that the pre-determined response does not include an axial force.

22. The fiber-reinforced actuator as defined in claim 19, wherein the body comprises an elastomeric tube.

23. The fiber-reinforced actuator as defined in claim 19, wherein the central axis is non-linear when the actuator is in a free state.

24. The fiber-reinforced actuator as defined in claim 19, wherein the control volume is a volume of fluid and the work performed on the control volume includes an increased fluid pressure.

25. The fiber-reinforced actuator as defined in claim 24, wherein the fluid comprises a gas.

26. A fiber-reinforced actuator assembly comprising a fiber-reinforced actuator as defined in claim 19 coupled together with at least one other fiber-reinforced actuator for coordinated movement.

27. The fiber-reinforced actuator assembly as defined in claim 26, wherein the fiber configuration of a first actuator of the assembly is different from the fiber configuration of a second actuator of the assembly.

28. The fiber-reinforced actuator assembly as defined in claim 26, wherein the assembly is configured so that each one of the actuators can be independently actuated to provide a plurality of combinations of mobility directions.

29. The fiber-reinforced actuator assembly as defined in claim 26, wherein respective control volumes of each fiber-reinforced actuator of the assembly are selectively interconnected with each other in series.

30. The fiber-reinforced actuator assembly as defined in claim 26, wherein the fiber-reinforced actuators are coupled together in parallel.

31. A fiber-reinforced actuator assembly comprising two or more fiber-reinforced actuators as defined in claim 19 coupled together for coordinated movement.

32. The fiber-reinforced actuator as defined in claim 19, further comprising an additional fiber extending along the control volume and nonparallel with fibers of the first and second sets.

33. The fiber-reinforced actuator as defined in claim 19, wherein the actuator has a free state comprising a first shape and an actuated state comprising a second shape, and at least one of the first or second shapes is a helical shape.

34. A fiber-reinforced actuator, comprising:

a body having a control volume, the body extending for a length along a central axis of the control volume;

a first set of fibers coupled with the body for coordinated movement with the body, the fibers of the first set extending along the body at an angle $\alpha$ relative to the central axis;

a second set of fibers coupled with the body for coordinated movement with the body, the fibers of the second set extending along the body at an angle $\beta$ relative to the central axis, wherein $\alpha \neq \beta$; and an additional fiber extending along the body at a third angle $\gamma$ relative to the central axis, wherein $\gamma$ is any angle other than $\alpha$, $\beta$, or 0°, wherein the fibers of the first and second sets of fibers and the additional fiber are exclusive of the control volume and are configured to predictably constrain movement of the body in response to work performed on the control volume to cause the actuator to predictably change in shape or effective rigidity when said work is performed on the control volume, and wherein the actuator has a free state comprising a first shape and an actuated state comprising a second shape, and at least one of the first or second shapes is a helical shape.

35. The fiber-reinforced actuator as defined in claim 34, wherein $\alpha = -\beta$.

36. A fiber-reinforced actuator assembly comprising a fiber-reinforced actuator as defined in claim 34 coupled together with at least one other fiber-reinforced actuator for coordinated movement.

37. The fiber-reinforced actuator assembly as defined in claim 36, wherein respective control volumes of each fiber-reinforced actuator of the assembly are selectively interconnected with each other in series.

38. The fiber-reinforced actuator assembly as defined in claim 36, wherein the fiber-reinforced actuators are coupled together in parallel.

39. A fiber-reinforced actuator, comprising:

a body having a control volume, the body extending for a length along a central axis of the control volume;

a first set of fibers coupled with the body, the fibers of the first set extending along the body at an angle $\alpha$ relative to the central axis; and a second set of fibers coupled with the body, the fibers of the second set extending along the body at an angle $\beta$ relative to the central axis;

wherein the fibers of said first and second sets of fibers are exclusive of the control volume and are configured to constrain movement of the body in response to work performed on the control volume to cause the actuator to predictably change in shape or effective rigidity when said work is performed on the control volume, and wherein $\alpha \neq \pm\beta$, and the orientation of the fibers of the first and second sets of fibers meets one of the following criteria:

$-90° > \alpha > 90°$ and $-90° > \beta > 90°$; or $\alpha = 90°$ and $\beta \neq 0$, wherein the orientation of the fibers of the first and second sets of fibers meets the following additional criteria:

$$\alpha = \cot^{-1}\left[\frac{-1}{2\cot(\beta)}\right].$$

40. The fiber-reinforced actuator as defined in claim 39, wherein the body comprises an elastomeric tube.

41. The fiber-reinforced actuator as defined in claim 39, wherein the central axis is non-linear when the actuator is in a free state.

42. The fiber-reinforced actuator as defined in claim 39, wherein the fibers of the first and second sets of fibers are at least partially embedded in the body.

43. The fiber-reinforced actuator as defined in claim 39, wherein the control volume is a volume of fluid.

44. The fiber-reinforced actuator as defined in claim 43, wherein the fluid comprises a gas.

45. A fiber-reinforced actuator assembly comprising a fiber-reinforced actuator as defined in claim 39 coupled together with at least one other fiber-reinforced actuator for coordinated movement.

46. The fiber-reinforced actuator assembly as defined in claim 45, wherein respective control volumes of each fiber-reinforced actuator of the assembly are selectively interconnected with each other in series.

47. The fiber-reinforced actuator assembly as defined in claim 45, wherein the fiber-reinforced actuators are coupled together in parallel.

48. A fiber-reinforced actuator assembly comprising two or more fiber-reinforced actuators as defined in claim 39 coupled together for coordinated movement.

49. The fiber-reinforced actuator as defined in claim 39, wherein at least one fiber comprises a shape memory alloy.

50. The fiber-reinforced actuator as defined in claim 39, further comprising an additional fiber extending along the control volume at any angle other than $\alpha$ or $\beta$.

51. The fiber-reinforced actuator as defined in claim 39, wherein at least one of the angles $\alpha$ or $\beta$ changes along the length of the body.

* * * * *